US006482044B1

(12) United States Patent
Ma et al.

(10) Patent No.: US 6,482,044 B1
(45) Date of Patent: Nov. 19, 2002

(54) AUDIO JACK

(75) Inventors: Xuedong Ma; GuangXing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/011,339

(22) Filed: Nov. 5, 2001

(30) Foreign Application Priority Data

Oct. 12, 2001 (TW) ..... 090217379

(51) Int. Cl.[7] ..... H01R 24/04

(52) U.S. Cl. ..... 439/668

(58) Field of Search ..... 439/668, 607–610, 439/188, 944

(56) References Cited

U.S. PATENT DOCUMENTS 5,338,215 A * 8/1994 Lee et al. ..... 439/668
6,050,854 A * 4/2000 Fang et al. ..... 439/668
6,056,602 A * 5/2000 Wu ..... 439/668
6,077,126 A * 6/2000 Peng ..... 439/668

* cited by examiner

*Primary Examiner*—Gary F. Paumen
(74) *Attorney, Agent, or Firm*—Wei Te Chung

(57) ABSTRACT

An audio jack (1) comprises an insulative housing (3), a shield (2) enclosing the housing, and a plurality of contacts (4) assembled in the housing. The housing comprises a mating face (32) toward a complementary plug connector, a pair of mating heads (320) extending forwardly from the mating face, and two pairs of opposite supporting ribs (321) formed at the junctions between the mating head and the mating face to protect the mating heads from being broken for repeated insertions or undue insertion.

1 Claim, 7 Drawing Sheets

AUDIO JACK

BACKGROUND OF THE INVENTION

1. Field of the Invention

The present invention relates to an audio jack, and particularly to an audio jack that has a robust mating head to bear repeated insertions or undue insertion.

2. Description of Related Art

Generally, an audio jack comprises an insulative housing with a mating head extending forwardly from the housing for mating with a mating plug connector. As the plug connector is frequently inserted into or pulled out of the audio jack, the mating head and the housing must bear certain stress. Japanese Patent No. 6-36255[U] discloses a conventional audio jack. Referring to FIG. 7, a conventional audio jack 6 comprises an insulative housing 60 and a pair of contacts 61 assembled in the housing 60. The housing 60 comprises a forwardly extending cylindrical mating head 601. Because the audio jack 6 is slender, the housing 60 and the mating head 601 are weak in structure. In addition, the junction between the mating head 601 and the housing 60 has no additional means to reinforce the mating head 601, so the mating head 60 is easy to break after repeated insertions.

Hence, an improved audio jack is required to overcome the disadvantage of the conventional audio jack.

SUMMARY OF THE INVENTION

Accordingly, the object of the present invention is to provide an audio jack with enough intensity for increasing its lifespan.

In order to achieve the object set forth, an audio jack in accordance with the present invention comprises an insulative housing, a grounding shield enclosing the housing, and two pairs of contacts assembled in the housing. The housing comprises a mating face facing a complementary plug connector and a pair of cylindrical mating heads extending forwardly from the mating face. Two pairs of opposite supporting ribs extend forwardly from junctions between the mating heads and the mating face. The shield comprises a plurality of board locks extending downwardly from transverse edges thereof for retaining the audio jack on a mating printed circuit board. In mating, the supporting ribs enhance the intensity of the junctions between the mating head and mating face, thereby preventing the mating head from breakage.

Other objects, advantages and novel features of the invention will become more apparent from the following detailed description when taken in junction with the accompanying drawings.

DETAILED DESCRIPTION OF THE INVENTION

Figure 1:
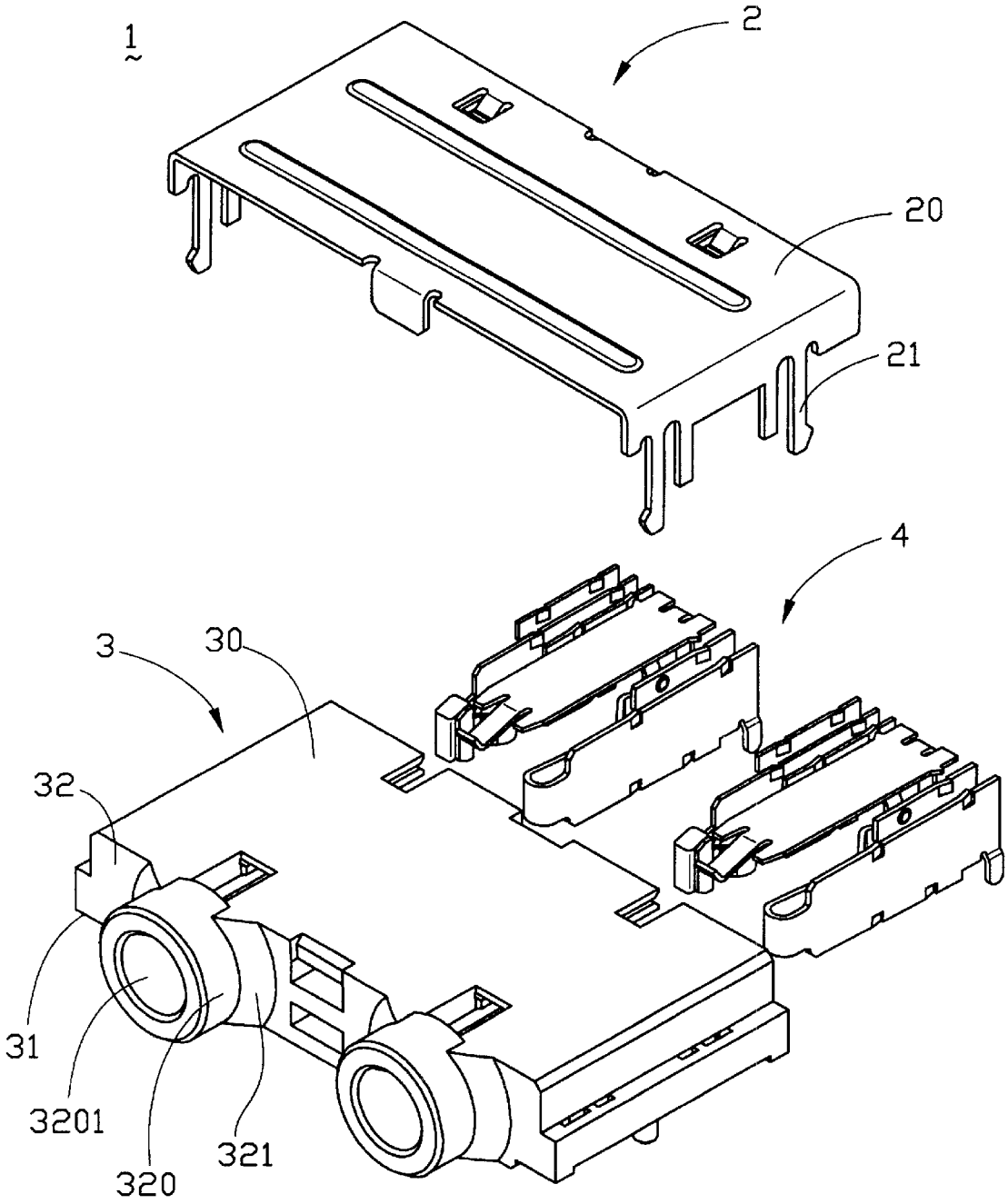
FIG. 1 is a perspective, exploded view of an audio jack of the present invention.

Reference will now be made to the drawing figures to describe the present invention in detail. Referring to FIG. 1, an audio jack connector 1 of the present invention comprises an insulative housing 3, a grounding shield 2 for enclosing the housing 3, and two sets of contacts 4 for being received in the housing 3.

The housing 3 comprising a mating face 32 toward a complementary plug connector (not shown), a top face 30 and an opposite bottom face 31. The housing 3 comprises a pair of mating heads 320 extending forwardly from the mating face 32. Each mating head 320 defines a receiving hole 3201 for insertion of the plug connector. A pair of integral annular supporting ribs 321 are provided between the junctions of each mating head 320 and the mating face 32. When the mating heads 320 mate with complementary plug connectors, the supporting ribs 321 protect the mating heads 320 from being broken due to repeated insertions or undue insertion.

The shield 2 comprises a planar base plate 20 for covering the top face 30 of the housing 3 and two pairs of board locks 21 extending downwardly from opposite transverse edges thereof.

Figure 2:
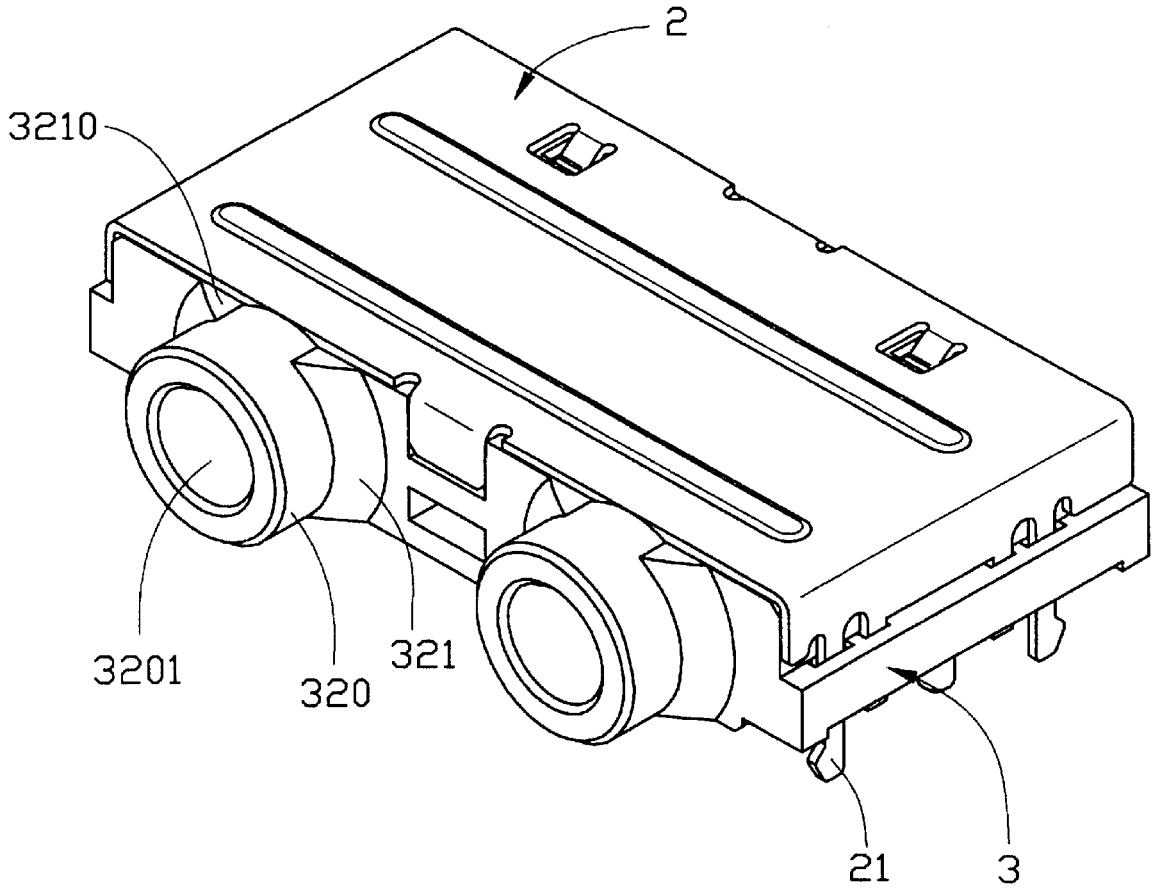
FIG. 2 is a perspective, assembled view of the audio jack in FIG. 1.
Figure 3:
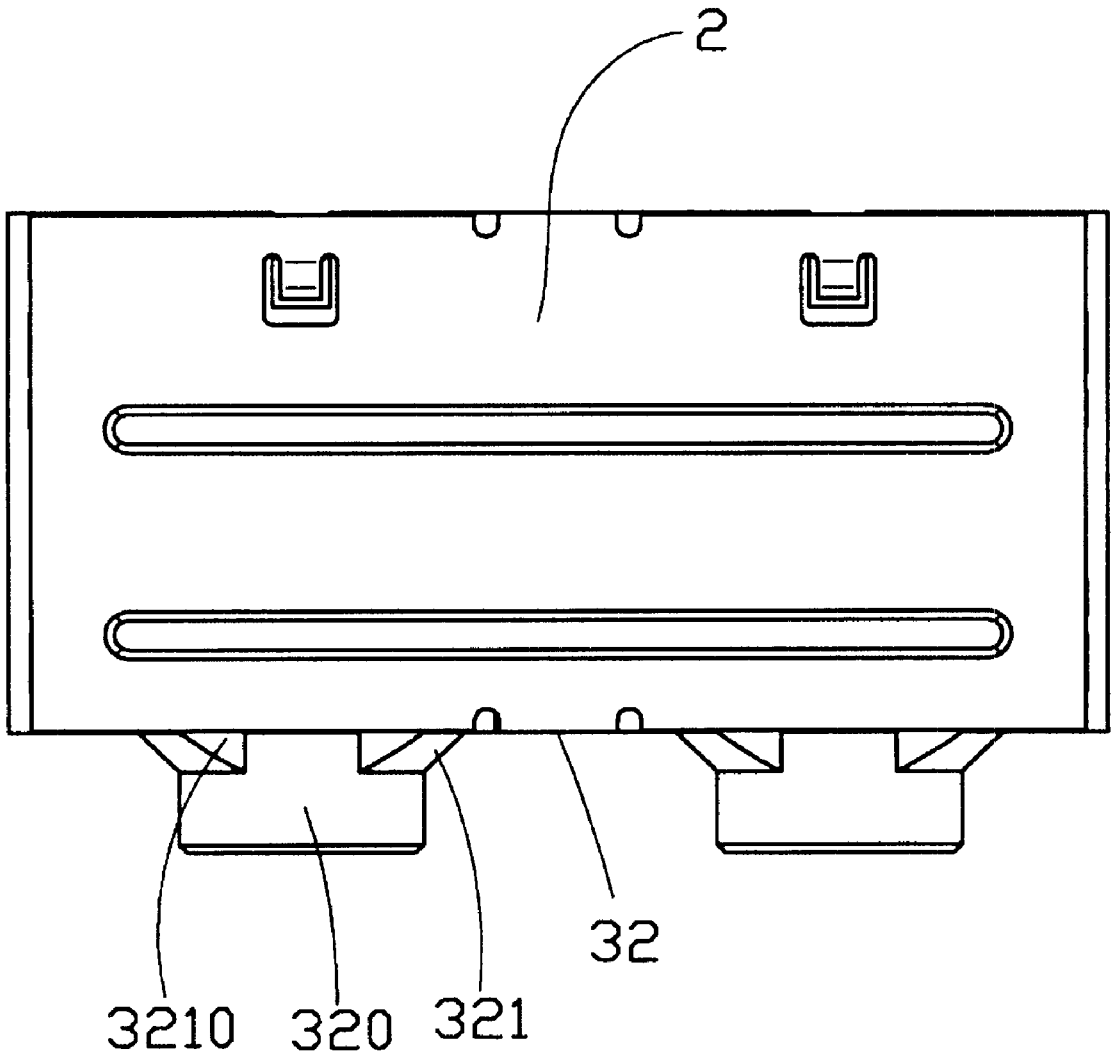
FIG. 3 is a top view of FIG. 2.

Referring to FIGS. 2 and 3, in assembly, the contacts 4 are assembled in the housing 3. Subsequently, the shield 2 is placed on the top face 30 of the housing 3 with the board locks 21 extending through the housing 3 and being inserted into a mating printed circuit board (PCB) (not shown) to securely retain the audio jack 1 on the PCB.

In this embodiment, the supporting ribs 320 are substantially triangular in cross section. Thus, the structural strength of the junctions between the mating heads 320 and the mating face 32 are effectively enhanced by the supporting ribs 321, and the mating heads 320 can be protected by the supporting ribs 321 from being broken by undue insertion.

Figure 4:
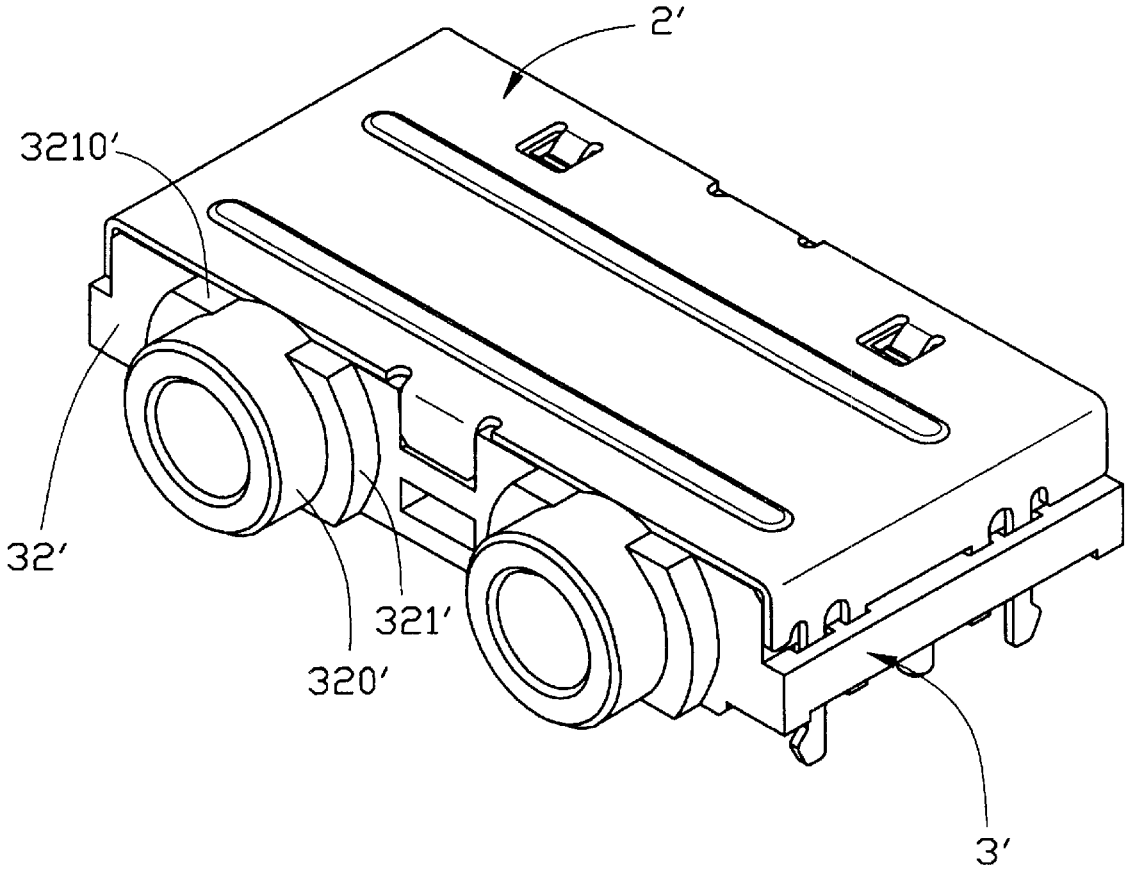
FIG. 4 is a perspective, assembled view of an alternative embodiment of the present invention.
Figure 5:
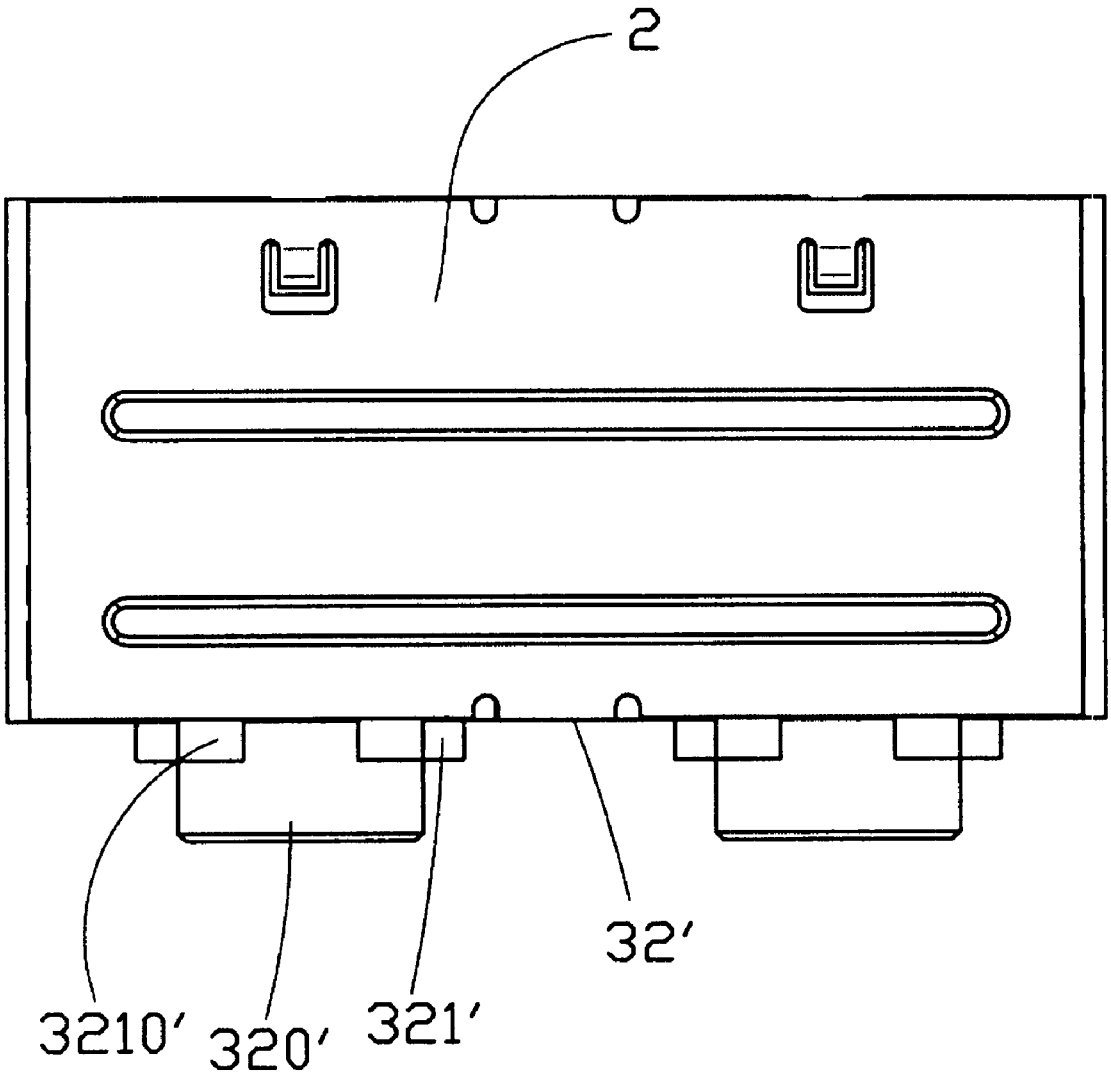
FIG. 5 is a top view of FIG. 4.

FIGS. 4 and 5 show an alternative embodiment of the present invention. In this embodiment, each supporting rib 321' has a substantially rectangular cross section 3210'. Thus, the intensity of the junctions between the mating heads 320' and the mating face 32' are also effectively enhanced by the supporting ribs 321'. The other components of this embodiment are the same as the first embodiment described in the above; thus, a detailed description thereof is omitted here.

Figure 6:
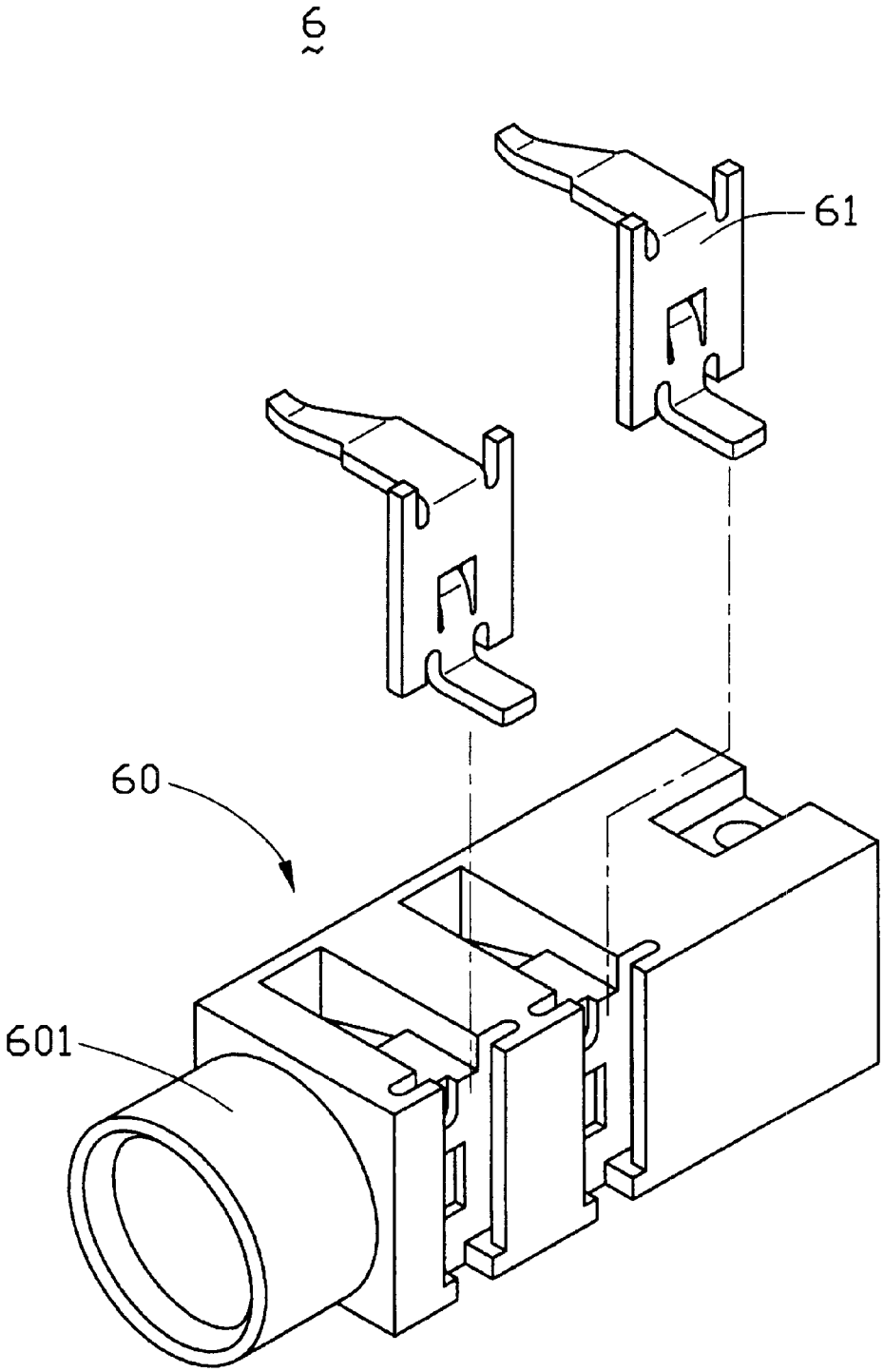
FIG. 6 (PRIOR ART)
FIG. 6 is a perspective, assembled view of another embodiment of the present invention.
Figure 7:
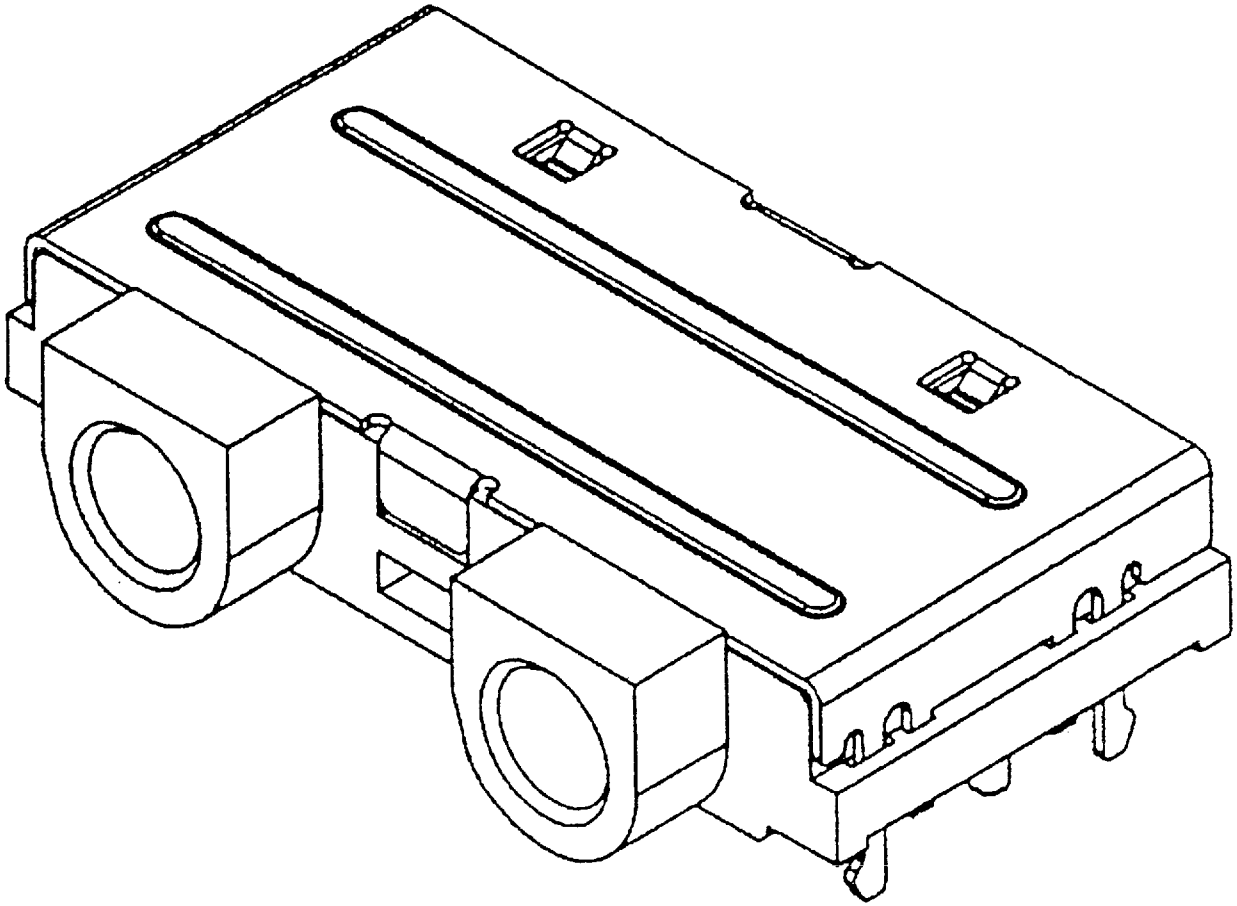
FIG. 7 is a perspective, exploded view of a conventional audio jack.

FIG. 6 shows another embodiment wherein the reinforcement rib mechanism of right angle contours is formed around both two opposite upper corners of the cylindrical head, and cooperates with the uppermost portion of the head to be commonly flush with the grounding shield and abut against the front edge of the grounding shield.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An jack type connector for mating with a plug type connector, comprising:

an insulative housing extending along a longitudinal direction comprising a pair of mating face with a mating cylindrical heads extending forwardly therefrom;

a plurality of contacts disposed in the housing; and a reinforcement rib formed on at least a root portion of each head and connecting to said mating face; wherein said reinforcement rib partially circumferentially surrounds said heads wherein said reinforcement rib is formed at a junction between the head and the mating face;

wherein an uppermost portion of said head is higher than a top face of said housing, and an uppermost point of said reinforcement rib does not extend beyond the top face;

wherein a grounding shield extending along said longitudinal direction and attached upon and fully covering the top face, and said uppermost portion of the head abuts against a front edge of said grounding shield in a front-to-back direction;

said grounding shield including at two opposite longitudinal ends thereof two opposite side walls extending downwardly through two corresponding step sections at two opposite longitudinal ends of said housing;

wherein said grounding shield further includes a grasp attached to a middle portion of said mating face between said pair of mating heads;

wherein uppermost portions of the mating heads are generally flush with said grounding shield;

wherein each of said ribs defines the same cross-sectional configuration taken along said longitudinal direction.

* * * * *